US007954987B2

(12) United States Patent
Yagi

(10) Patent No.: US 7,954,987 B2
(45) Date of Patent: Jun. 7, 2011

(54) VEHICLE LAMP

(75) Inventor: Takayuki Yagi, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 332 days.

(21) Appl. No.: 12/145,274

(22) Filed: Jun. 24, 2008

(65) Prior Publication Data

US 2009/0003010 A1 Jan. 1, 2009

(30) Foreign Application Priority Data

Jun. 27, 2007 (JP) ..... 2007-168953

(51) Int. Cl.
*F21V 5/00* (2006.01)
*F21V 21/00* (2006.01)

(52) U.S. Cl. ..... 362/545; 362/520

(58) Field of Classification Search ..... 362/555, 362/282, 459–549, 800
See application file for complete search history.

(56) References Cited

U.S. PATENT DOCUMENTS

| | | | | |
|---|---|---|---|---|
| 7,210,831 | B2 * | 5/2007 | Ishida | 362/539 |
| 2005/0068786 | A1 | 3/2005 | Ishida | |
| 2006/0050526 | A1 * | 3/2006 | Ikeda et al. | 362/555 |

FOREIGN PATENT DOCUMENTS

| | | | |
|---|---|---|---|
| DE | 102004046173 | A1 | 5/2005 |
| DE | 102004043706 | A1 | 4/2006 |
| JP | 2005-44683 | | 2/2005 |

OTHER PUBLICATIONS

German Office Action for Application No. 10 2008 030 597.9, mailed on Jul. 30, 2009 (5 pages).
esp@cenet Patent Abstract for German Publication No. 102004046173, publication date May 12, 2005. (1 page).
esp@cenet patent abstract 2005044683 dated Feb. 17, 2005 (2 pages).

* cited by examiner

*Primary Examiner* — Bao Q Truong
(74) *Attorney, Agent, or Firm* — Osha • Liang LLP

(57) ABSTRACT

A vehicle lamp includes a convex lens and a light emitting device. Light directly reaching a rear surface of the convex lens from the light emitting device is deflected through the convex lens to form a light distribution pattern having a horizontal cutoff line and an oblique cutoff line. The light emitting device includes a light emitting chip having a rectangular light emitting surface oriented to face the rear surface of the convex lens, and a corner of the rectangular light emitting surface is disposed on a rear focal point of the convex lens. A front surface of the convex lens includes a horizontally diffusing region which diffuses a part of the light in the horizontal direction, and an obliquely diffusing region which diffuses another part of the light toward the self lane side in an oblique direction forming an upward angle with respect to the horizontal plane.

8 Claims, 11 Drawing Sheets

VEHICLE LAMP

BACKGROUND OF INVENTION

1. Field of the Invention

The present invention relates to a vehicle lamp having a light emitting device as a light source, more specifically, to a vehicle lamp configured to irradiate light to form a light distribution pattern having a horizontal cutoff line and an oblique cutoff line at an upper end thereof 2. Background Art In recent years, light emitting devices, such light emitting diodes, are increasingly being used light sources of vehicle lamps.

For example, a related-art vehicle lamp includes a convex lens arranged on an optical axis extending in a front-and-rear direction of the lamp, and a light emitting device arranged substantially on a rear focal point of the convex lens (see, e.g., JP 2005-44683 A). This vehicle lamp is a direct-optical type lamp (a non-reflector type lamp), which is configured to deflect direct light from the light emitting device through the convex lens.

The vehicle lamp further includes a shade disposed in front of the light emitting device. The shade shields a portion of the direct light, whereby a light distribution pattern having a horizontal cutoff line or an oblique cutoff line at an upper end thereof is formed.

According to such a configuration, the vehicle lamp can be downsized. Further, an upper end edge of the shade may be designed to form a light distribution pattern having a horizontal cutoff line and an oblique cutoff line at an upper end thereof However, according to such a vehicle lamp, there is a disadvantage in that a luminous flux from the light source cannot effectively be utilized as a portion of the direct light from the light emitting device is shielded by the shade.

SUMMARY OF INVENTION

One or more exemplary embodiments of the present invention provide a direct-optical type vehicle lamp having a light emitting device as a light source, and which is configured to form a light distribution pattern having a horizontal cutoff line and an oblique cutoff line at an upper end thereof with improved utilization efficiency of a luminous flux from the light source.

According to one or more exemplary embodiments of the present invention, a vehicle lamp includes a convex lens disposed on an optical axis extending in a front-and-rear direction of a vehicle, the convex lens having a front surface and a rear surface, and a light emitting device comprising a light emitting chip, the light emitting chip having a rectangular light emitting surface oriented to face the rear surface of the convex lens. Light directly reaching the rear surface of the convex lens from the light emitting device is deflected through the convex lens to form a light distribution pattern having a horizontal cutoff line and an oblique cutoff line along an upper end of the light distribution pattern. A lower side edge of the light emitting chip is disposed along a horizontal plane including the optical axis, and an end point of the lower side edge on a self lane side is disposed on a rear focal point of the convex lens. The front surface of the convex lens includes a horizontally diffusing region which diffuses a part of the light in the horizontal direction, and an obliquely diffusing region which diffuses another part of the light toward the self lane side in an oblique direction forming an upward angle with respect to the horizontal plane.

According to one or more exemplary embodiments of the present invention, a vehicle lamp includes a convex lens disposed on an optical axis extending in a front-and-rear direction of a vehicle, the convex lens having a front surface and a rear surface, and a light emitting device comprising a light emitting chip, the light emitting chip having a rectangular light emitting surface oriented to face the rear surface of the convex lens. Light directly reaching the rear surface of the convex lens from the light emitting device is deflected through the convex lens to form a light distribution pattern having a horizontal cutoff line and an oblique cutoff line along an upper end of the light distribution pattern. A lower side edge of the light emitting chip is disposed along an inclined plane forming an upward angle with respect to a horizontal plane including the optical axis, and an end point of the lower side edge on an opposing lane side is disposed on a rear focal point of the convex lens. The front surface of the convex lens includes a horizontally diffusing region which diffuses a part of the light in the horizontal direction, and an obliquely diffusing region which diffuses another part of the light toward a self lane side in an oblique direction forming the upward angle with respect to the horizontal plane.

The light emitting device is a light source device having a surface-emitting chip from which the light is emitted substantially in a point-like shape. A kind of the light emitting device is not particularly limited, for example, a light emitting diode, a laser diode or the like can be adopted. Further, a size and a longitudinal and lateral ratio of the light emitting surface of the light emitting chip is not particularly limited in so far as the shape is a rectangular.

A position and an area of forming the horizontally diffusing region is not particularly limited in so far as the horizontally diffusing region is a portion of the front surface of the convex lens. Likewise, a position and an area of forming the obliquely diffusing region is not particularly limited in so far as obliquely diffusing region is a portion of the front surface of the convex lens other than the horizontally diffusing region.

The horizontally diffusing region may be configured to diffuse light uniformly in a left and right direction or may be configured to diffuse light non-uniformly in the left and right direction so far as the horizontally diffusing region is configured to emit light from the light emitting device as light diffusing in the horizontal direction Further, a size of an angle of diffusing emitting light with respect to the horizontal direction is not particularly limited to a specific value thereof The obliquely diffusing region may be configured to diffuse light uniformly in a left and right direction along the oblique direction, may be configured to diffuse light non-uniformly in the left and night direction so far as the obliquely diffusing region is configured to diffuse the light from the light emitting device in the oblique direction with an upward angle toward the self lane side with respect to the horizontal direction. Further, a size of an angle of diffusing emitting light with respect to the horizontal direction is not particularly limited to a specific value thereof.

The specific value of the upward angle is not particularly limited, but can be set to a value of about, for example, 15°.

Other aspects and advantages of the invention will be apparent from the following description, the drawings and the claims.

DETAILED DESCRIPTION

Hereinafter, exemplary embodiments of the invention will be explained with reference to the drawings.

First Exemplary Embodiment

Figure 1:
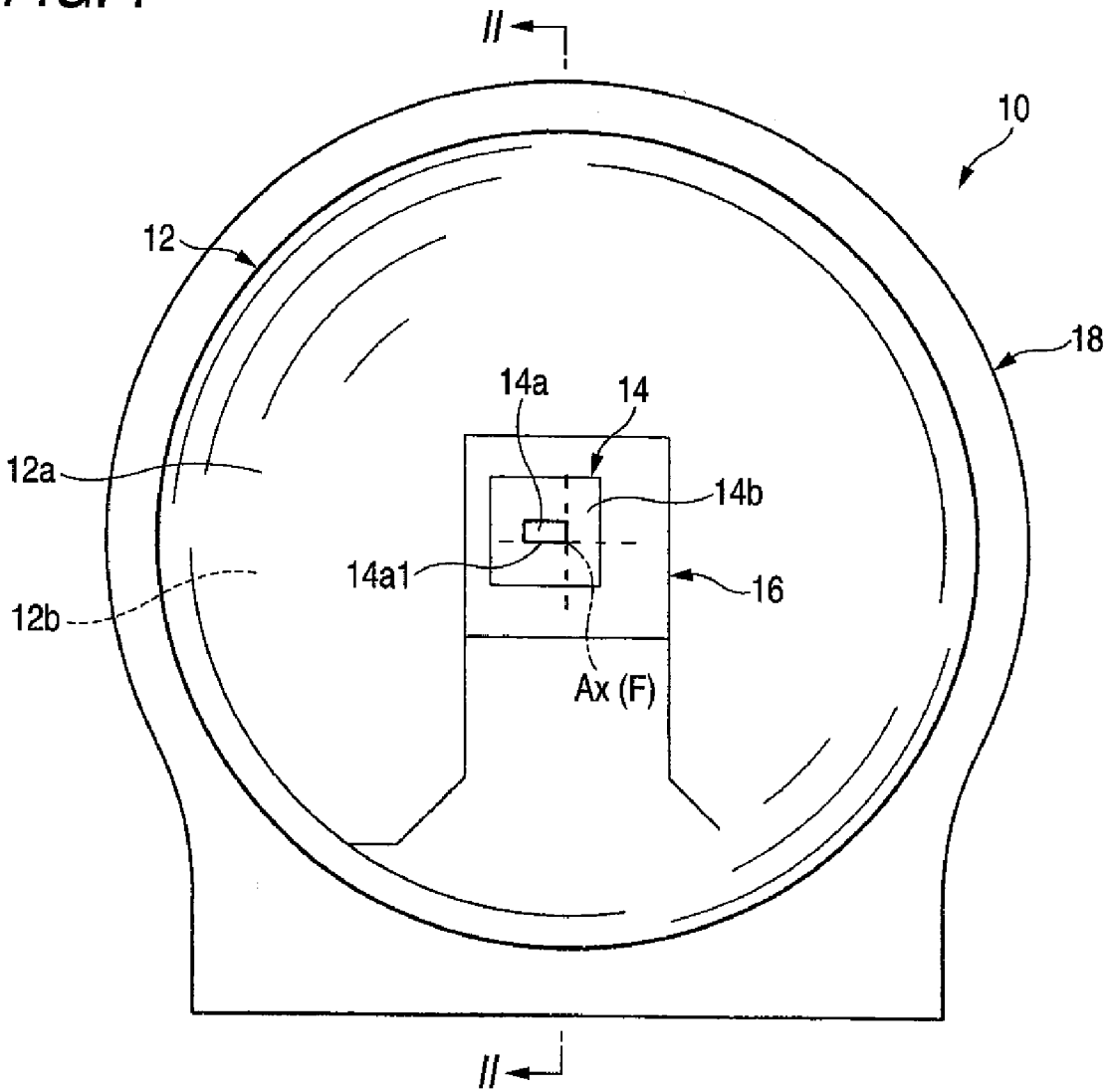
FIG. 1 is a front view showing a vehicle lamp according to a first exemplary embodiment of the invention.
Figure 2:
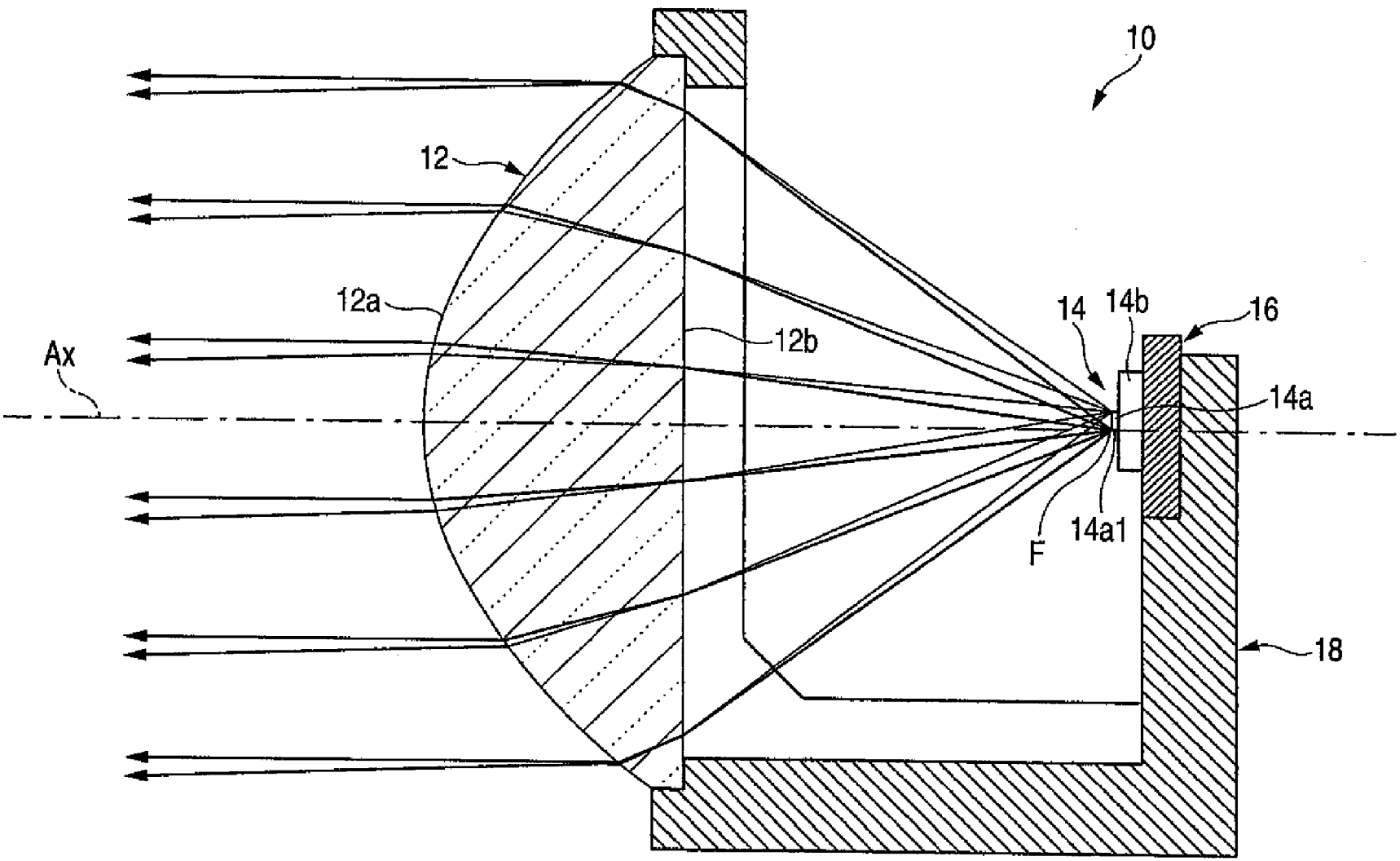
FIG. 2 is a sectional view taken along the line II-II in FIG. 1.

FIG. 1 is a front view showing a vehicle lamp 10 according to the first exemplary embodiment and FIG. 2 is a sectional view taken along the line II-II in FIG. 1.

As shown in FIGS. 1 and 2, a vehicle lamp 10 according to a first exemplary embodiment includes a convex lens 12 arranged on an optical axis Ax extending in a front-and-rear direction of a vehicle, a light emitting device 14 arranged at a vicinity of a rear focal point F of the convex lens 12, a metal plate 16 for supporting the light emitting device 14, and a base member 18 for fixedly supporting the metal plate 16 and the convex lens 12. The vehicle lamp 10 is used as a lamp unit of a vehicular headlamp integrated into a lamp body or the like, not illustrated, to be able to adjust the optical axis.

The vehicle lamp 10 is arranged such that the optical axis Ax is extended in a direction directed downward by about 0.5° to about 0.6° with respect to the front-and-rear direction of the vehicle.

The convex lens 12 has a shape similar to a shape of a planoconvex aspherical lens having a convex front surface 12*a* and a flat rear surface 12*b*, and is arranged on the optical axis Ax. A sectional shape of the front surface 12*a* of the convex lens 12 taken along a vertical plane including the optical axis Ax is a sectional shape of the front surface of the planoconvex aspherical lens. However, other sectional shapes of the front surface 12*a* of the convex lens 12 taken along a plane other than the vertical plane is a shape that is more or less deformed sectional shape of the front surface of the planoconvex aspherical lens. Therefore, specifically, the rear focal point F of the convex lens 12 is a rear focal point in the vertical plane including the optical axis Ax. Details of the front surface 12*a* of the convex lens 12 will be described later.

The light emitting device 14 is a white light emitting diode, and includes a light emitting chip 14*a* having a light emitting surface in a laterally long rectangular shape (e.g., a vertical side being about 1 mm and a lateral side being about 2 mm), and a board 14*b* for supporting the light emitting chip 14*a*. In that case, the light emitting chip 14*a* is sealed by a thin film formed to cover the light emitting surface.

The light emitting device 14 is arranged to be directed to a front side such that a lower side edge 14*a*1 of the light emitting chip 14*a* is disposed along a horizontal plane including the optical axis Ax and an end point of the lower side edge 14*a*1 on a self lane side (i.e., on the left side, or on the right side when seen from the front side of the lamp) is disposed on the rear focal point F of the convex lens 12.

Figure 3:
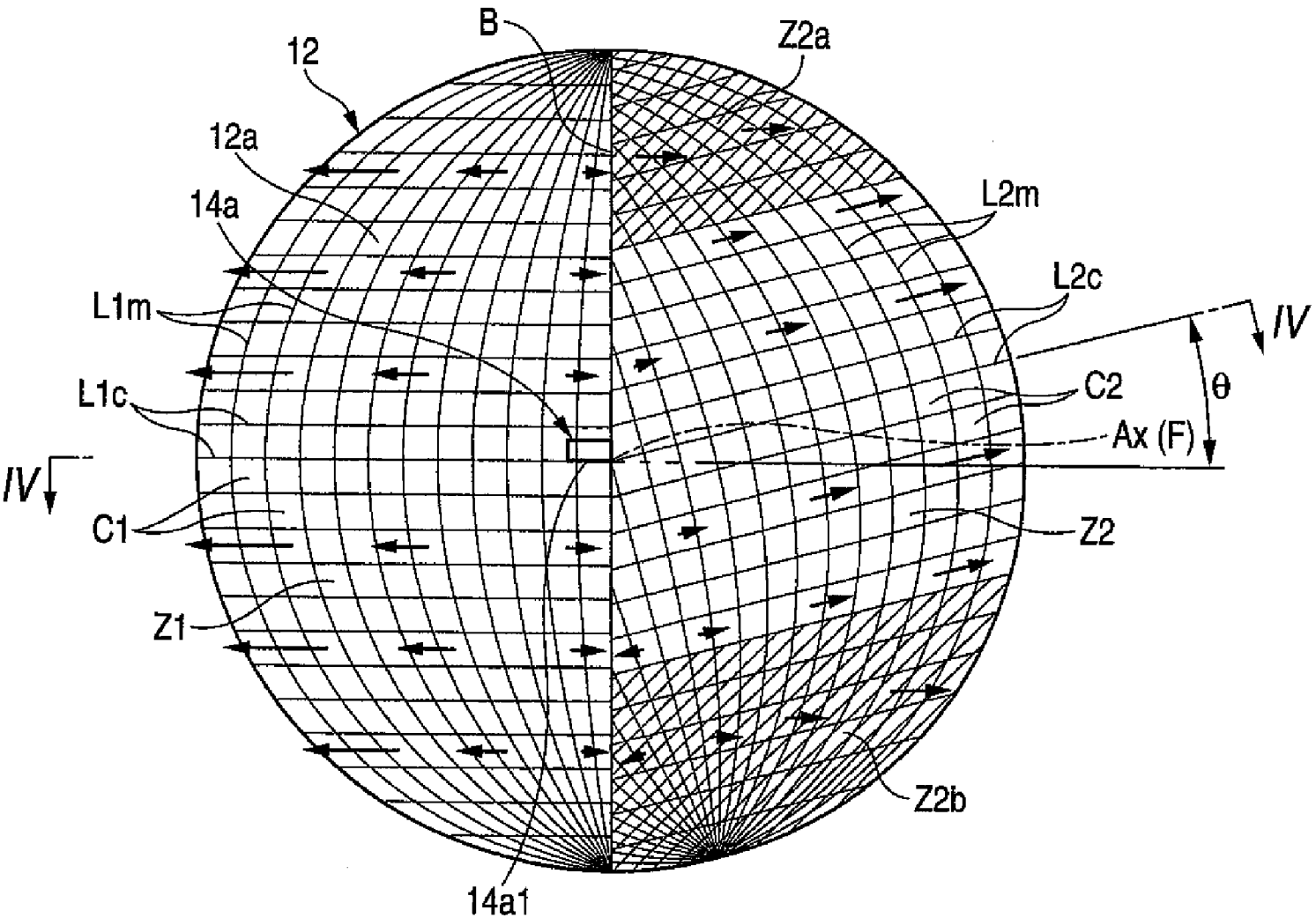
FIG. 3 is a front view showing a convex lens of the vehicle lamp along with a light emitting chip.
Figure 4:
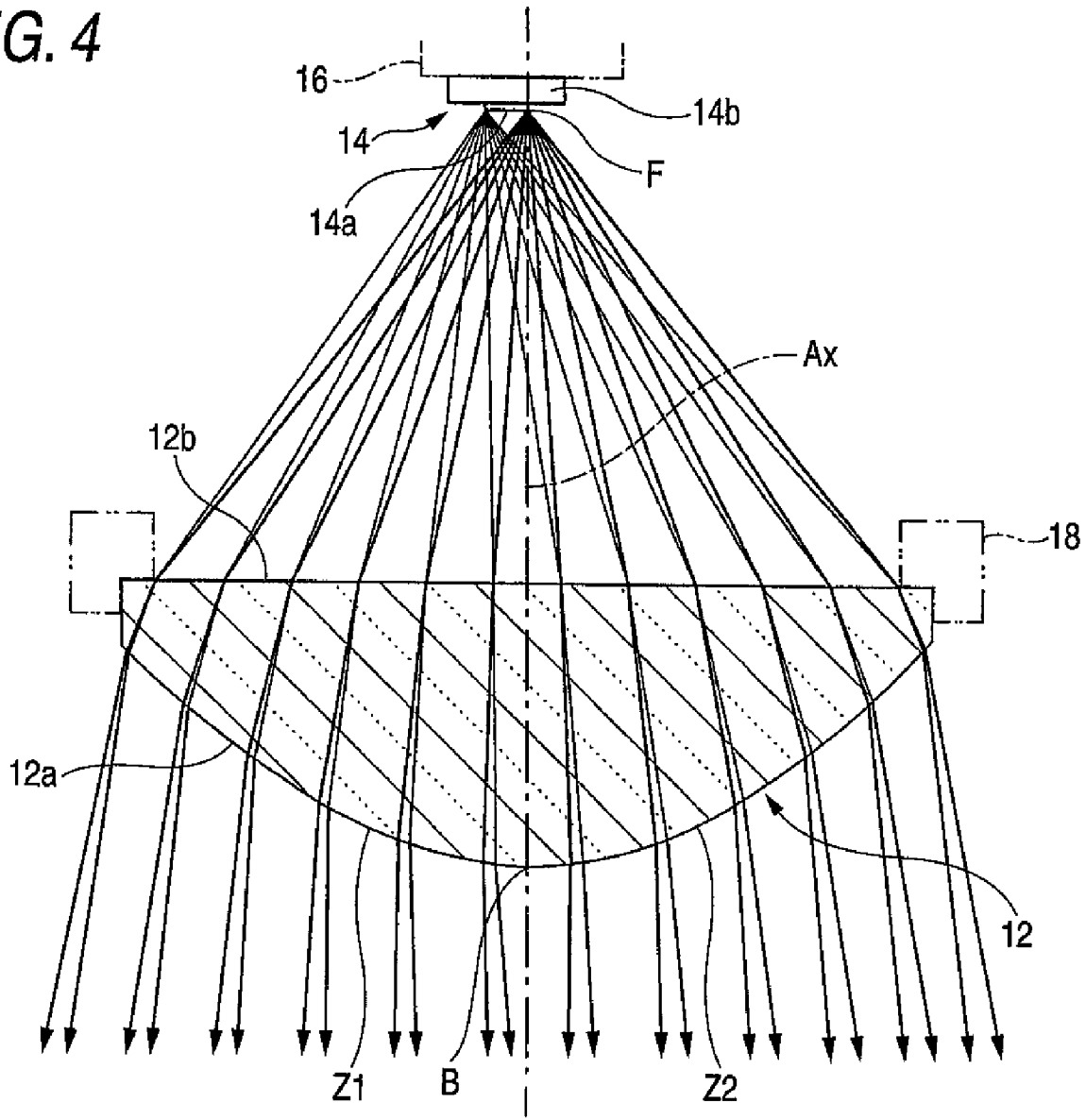
FIG. 4 is a sectional view taken along the line IV-IV in FIG. 3.

FIG. 3 is a front view showing the convex lens 12 along with the light emitting chip 14*a*, and FIG. 4 is a sectional view taken along the line IV-IV in FIG. 3.

As shown in FIGS. 3 and 4, the front surface 12*a* of the convex lens 12 includes a horizontally diffusing region Z1 over an entire region on an opposing lane side (i.e., on the right side, or on the left side when seen from the front side of the lamp) of the vertical plane including the optical axis Ax, and an obliquely diffusing region Z2 over an entire region on the self lane side of the vertical plane.

The horizontally diffusing region Z1 diffuses the light from the light emitting device 14 in a horizontal direction. The obliquely diffusing region Z2 diffuses the light from the light emitting device 14 toward the self lane side in an oblique direction which forms an upward angle θ of about 15° with respect to the horizontal direction.

Light emitted in the horizontally diffusing region Z1 is controlled so as to be diffused by setting directions of emitting light at respective positions of the horizontally diffusing region Z1.

That is, as shown in FIG. 3, the horizontally diffusing region Z1 is partitioned into a plurality of cells C1 by a plurality of curve lines L1*c* extended in a horizontal direction at equal intervals in an up and down direction, and a plurality of curve lines L1*m* extended in shapes of meridians from an upper end point over to a lower end point of a boundary line B of the horizontally diffusing region Z1 and the obliquely diffusing region Z2, and light emitting directions are set for the respective cells C1.

Specifically, as shown by arrow marks in FIG. 3, at the cells C1 proximate to the boundary line B, directions of emitting light are directed in slightly left directions; at the cells C1 proximate to an outer peripheral edge of the convex lens 12, directions of emitting light are directed in right directions by large angles to some degree; and, at the cells C1 disposed at middle positions thereof, directions of emitting light are directed in middle directions. At respective stages, directions of emitting light are gradually changed in horizontal faces from the cells C1 contiguous to the boundary line B to the cells C1 contiguous to the outer peripheral edge of the convex lens 12.

On the other hand, light emitted in the obliquely diffusing region Z2 is controlled so as to be diffused by setting directions of emitting light at respective positions of the obliquely diffusing region Z2 similar to the case of the horizontally diffusing region Z1.

That is, as shown in FIG. 3, the obliquely diffusing region Z2 is partitioned by a plurality of cells C2 and light emitting directions are set for the respective cells C2. However, in the obliquely diffusing region Z2, curve lines L2*c* and L2*m* partitioning the plurality of cells C2 are extended to be inclined in a counterclockwise direction around the optical axis Ax by an amount of the angle θ in a front view of the lamp relative to the curve lines L1*c* and L1*m* of the horizontally diffusing region Z1.

Further, as shown by arrow marks in FIG. 3, at the cells C2 proximate to the boundary line B, directions of emitting light are directed slightly in left directions along the curve lines L2*c*; in the cells L2*c* proximate to the outer peripheral edge of the convex lens 12, directions of emitting light are directed in left directions by slightly large angles; and, at the cells C2 disposed at the middle positions thereof, directions of emitting light are directed in middle directions. At respective stages, directions of emitting light are gradually changed in inclined pane inclined by the angle θ relative to the horizontal direction from the cells C2 contiguous to the boundary line B to the cells C2 contiguous to the outer peripheral edge of the convex lens 12. However, at the cells in fan shape regions surrounded by the curve lines L2*m* extended from the optical axis Ax in downwardly oblique directions and the boundary line B, directions of emitting light are directed slightly in right directions along the curve lines L2*c*.

In an upper region Z2*a* and a lower region Z2*b* (regions indicated by hatchings in FIG. 3) of the obliquely diffusing region Z2, the light from the light emitting device 14 is diffused to lower sides (specifically, lower sides relative to the inclined plane). An amount of deflecting emitting light to lower sides is set such that the more proximate the cells C2 to the upper end point of the boundary line B and the respective lower end points of the curve lines L2*m* extended from the optical axis Ax in downwardly oblique directions, the larger the amount.

Further, arrow marks extended from center positions of the respective cells C1, C2 in FIG. 3 indicate directions of light incident on the convex lens 12 from the end point on the self lane side of the lower side edge 14*a*1 of the light emitting chip 14*a* (that is, position of the rear focal point F of the convex lens 12) emitted from the respective cells C1, C2 as shown by bold arrow marks in FIG. 4.

By forming the front surface 12*a* of the convex lens 12 in his way, a shape of a surface of the front surface 12*a* is discontinuous at the boundary line B of the horizontally diffusing region Z1 and the obliquely diffusing region Z2, and the boundary line B is formed as a ridge line.

Figure 5:
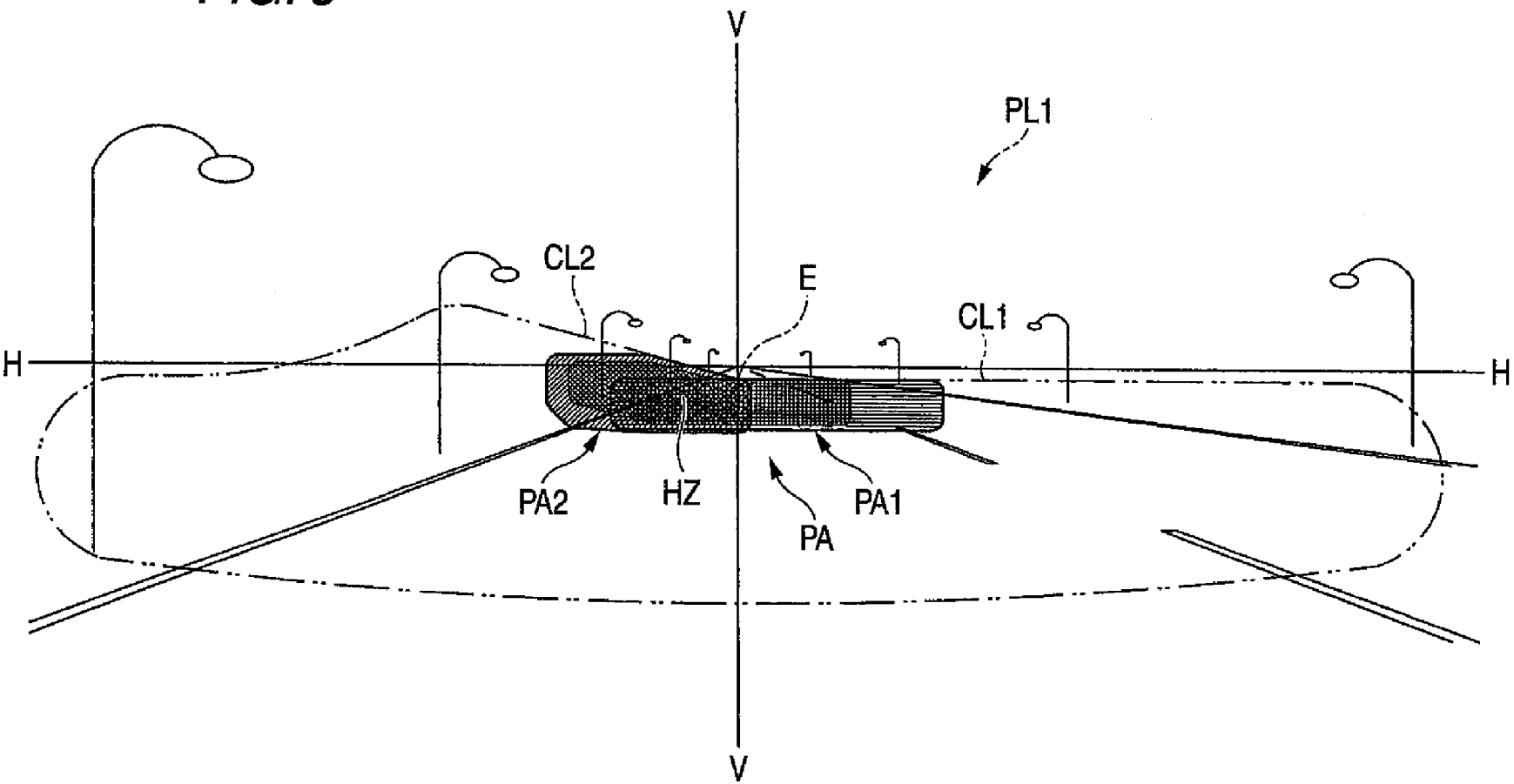
FIG. 5 is a diagram showing a perspective view of a light distribution pattern formed on an imaginary vertical screen arranged at a position 25 meters (m) frontward from a lamp by light irradiated to a front side from the vehicle lamp.

FIG. 5 is a diagram showing a perspective view of a light distribution pattern PA formed on an imaginary vertical screen arranged at a position 25 meters (m) frontward from the lamp by light irradiated to a front side from the vehicle lamp 10 according to the exemplary embodiment.

As shown in the drawings, the light distribution pattern PA is a light distribution pattern formed as a portion of a light distribution pattern PA1 for a low beam indicated by a two-dotted chain line, and is formed as a combined light distribution pattern of a first light distribution pattern PA1 and a second light distribution pattern PA2. Further, the low beam light distribution pattern PL1 is formed as a combined light distribution pattern of the light distribution pattern PA and a light distribution pattern formed by light irradiated to the front side from other lamp unit, not illustrated.

The low beam light distribution pattern PL1 is for left hand traffic, and includes horizontal and oblique cutoff lines CL1, CL2 at an upper end portion thereof The horizontal cutoff line CL1 is formed on the opposing lane side relative to the vertical line V-V passing a vanishing point H-V in the front direction of the lamp, and the oblique cutoff line CL2 is formed on the self lane side, and an elbow point E, which is an intersecting point of the cutoff lines CL1, CL2, is disposed on a lower side of the vanishing point H-V by about 0.5° to about 0.6°. In the low beam light distribution pattern PL1, a hot zone HZ, which is a high luminous intensity region, is formed so as to surround the elbow point E, particularly on a left side of the elbow point E.

The first light distribution pattern PA1 is a light distribution pattern formed by light emitting from the horizontally diffusing region Z1 and is formed such that an upper end edge thereof is made to substantially coincide with the horizontal cutoff line CL1. On the other hand, the second light distribution pattern PA2 is a light distribution pattern formed by light emitting from the obliquely diffusing region Z2 and is formed such that an upper end thereof is made to substantially coincide with the oblique cutoff line CL2. Further, the hot zone HZ of the light distribution pattern PL for low beam is mainly formed by a duplicated portion of the two light distribution patterns PA1, PA2.

Figure 6A:
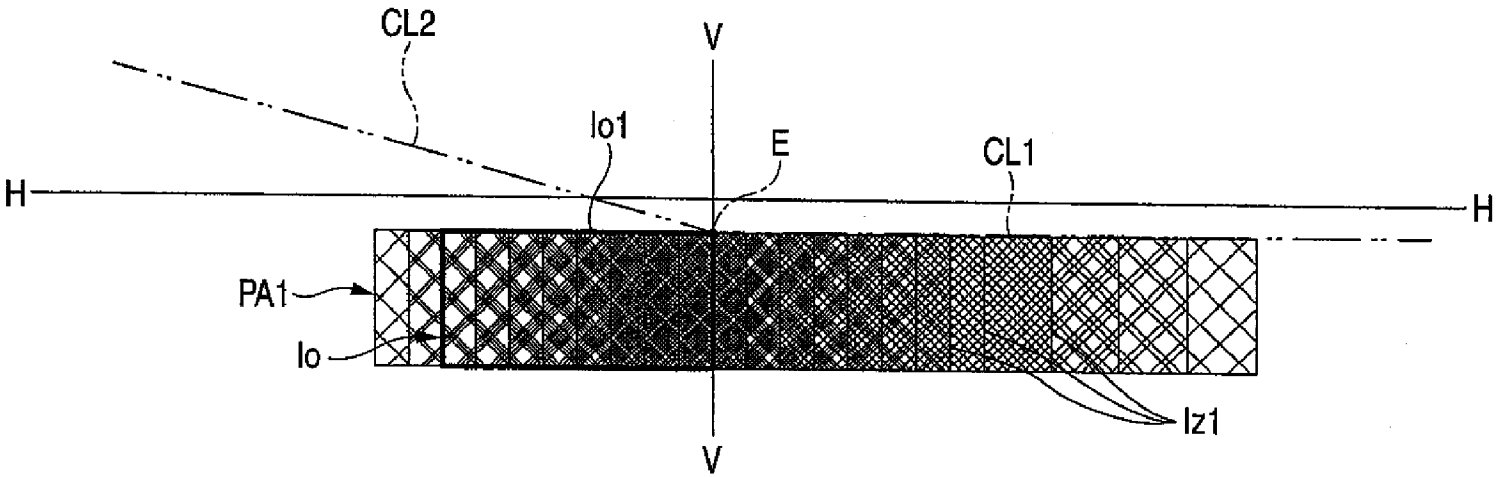
FIG. 6A is a detailed diagram of a first light distribution pattern, which is a portion of the light distribution pattern shown in FIG. 5.
Figure 6B:
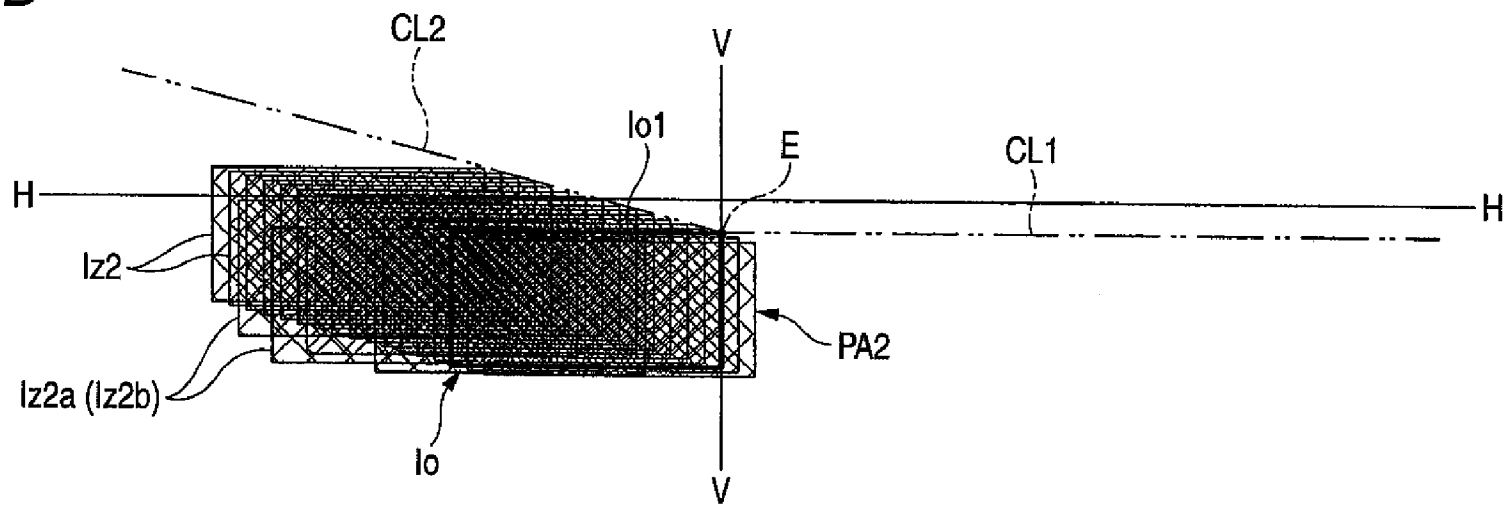
FIG. 6B is a detailed diagram of a second light distribution pattern, which is another portion of the light distribution pattern shown in FIG. 5.

FIG. 6A is a detailed diagram of the first light distribution pattern PA1, and FIG. 6B is a detailed diagram of the second light distribution pattern PA2.

As shown FIGS. 6A and 6B, when the convex lens 12 is assumed to be a normal planoconvex aspherical lens, an inverted projection image Io is formed such that an end point on the opposing lane side of an upper end edge Io1 is disposed at a position of the elbow point E (that is, intersection of the imaginary vertical screen and the optical axis Ax) and the upper end edge Io1 is disposed on a horizontal line passing the elbow point E on the imaginary vertical screen. This is because the lower side edge 14*a*1 of the light emitting chip 14*a* is disposed along the horizontal plane including the optical axis Ax and the end point on the self lane side of the lower side edge 14*a*1 is disposed on the rear focal point F of the convex lens 12. The lower side edge 14*a*1 of the light emitting chip 14*a* is extended in the horizontal direction of the rear focal point F of the convex lens 12, and therefore, a bright and dark ratio of the upper end edge Io1 of the inverted projection image Io becomes extremely high.

More specifically, because the region the front surface 12*a* of the convex lens 12 on the opposing lane side of the vertical plane including the optical axis Ax is configured as the horizontally diffusing region Z1 and the region on the self lane side is configured as the obliquely diffusing region Z2, on the imaginary vertical screen, the first light distribution pattern PA1 is formed as a horizontally expanded inverted projection image Io by the light irradiated from the horizontally diffusing region Z1, and the second light distribution pattern PA2 is formed, on the self lane side, as an obliquely expanded inverted projection image Io extending in the upward angle θ with respect to the horizontal direction by the light irradiated from the obliquely diffusing region Z2.

In FIG. 6A, a spreading behavior of light in the first light distribution pattern PA1 is shown by overlapping a plurality of inverted projection images Iz1.

The first light distribution pattern PA1 is formed as a light distribution pattern elongating the inverted projection image Io of the light emitting chip 14*a* in a left direction by a small amount and elongated in a right direction by a large amount with regard to a horizontal direction. The upper end edge Io1 of the inverted projection image Io is disposed on the horizontal line passing the elbow point E, and, therefore, the upper end edge of the first light distribution pattern PA1 is provided with an extremely high bright and dark ratio. Accordingly, the horizontal cutoff line CL1 is made clearly.

On the other hand, in FIG. 6B, a spreading behavior of light in the second light distribution pattern PA2 is shown by overlapping pluralities of inverted projection images Iz2, Iz2*a* and Iz2*b*.

The second light distribution pattern PA2 is formed as a light distribution pattern elongating the inverted projection image Io of the light emitting chip 14*a* in a right direction by a small amount and elongating the inverted projection image Io in a left direction by a slightly large amount with regard to the oblique direction. A direction of extending the upper end edge Io1 of the inverted projection image Io and a direction of elongating the inverted projection image Io do not coincide with each other, and therefore, the bright and dark ratio of the upper end edge of the second light distribution pattern PA2 is not so high as that of the upper end edge of the first light distribution pattern PA1. However, a diffusing angle of the light distribution pattern PA2 is comparatively small, and, therefore, the oblique cutoff line CL2 becomes somewhat clear.

Although in the plurality of inverted projection images Iz2 of the second light distribution pattern PA2, the inverted projection images Iz2*a*, Iz2*b* formed by emitting light from the upper region Z2*a* and the lower region Iz2*b* of the obliquely diffusing region Z2 are disposed slightly on the lower side of the oblique cutoff line CL2, this is because light emitting from the upper region Z2*a* and the lower region Z2*b* becomes light diffused to the lower side.

As has been described in detail, the vehicle lamp 10 according to the above exemplary embodiment is configured such that direct light from the light emitting device 14 including the light emitting chip 14*a* having the light emitting surface in the rectangular shape is controlled to deflect by the convex lens 12, and thereby, the light distribution pattern PA having the horizontal and the oblique cutoff lines CL1, CL2 at the upper end portion is formed as a portion of the light distribution pattern PA1 for low beam. The light emitting device 14 is arranged directed to the front side such that the lower side edge 14*a*1 of the light emitting chip 14*a* is disposed along the horizontal plane including the optical axis Ax and the end point on the self lane side of the lower side edge 14*a*1 is disposed on the rear focal point F of the convex lens 12. Further, the front surface 12*a* of the convex lens 12 is configured such that one portion of the region is configured as the horizontally diffusing region Z1 and other portion of the region is configured as the obliquely diffusing region Z2, and, therefore, one or more of the following effects and advantages can be achieved.

That is, the light emitting device 14 is arranged directed to the front side at a vicinity of the rear focal point F of the convex lens 12, and, therefore, the inverted projection image Io of the light emitting chip 14*a* is formed on the imaginary vertical screen frontward from the lamp. The lower side edge 14*a* of the light emitting chip 14*a* is disposed along the horizontal plane including the optical axis Ax and the end point of the lower side edge 14*a*1 on the self lane side is disposed on the rear focal point F of the projected lens 12, and, therefore, when the convex lens 12 is assumed to be a normal planoconvex aspherical lens, the inverted projection image Io of the light emitting chip 14*a* is formed such that the end point on the opposing lane side of the upper end edge Io1 is disposed at the intersection of the imaginary vertical screen and the optical axis Ax and the upper end edge Io1 is disposed on the horizontal line passing the intersection on the imaginary vertical screen.

More specifically, a portion of the front surface 12*a* of the convex lens 12 is configured as the horizontally diffusing region Z1 which diffuses the light from the light emitting device 14 in the horizontal direction, and the other portion of the front surface 12*a* of the convex lens 12 is configured as the obliquely diffusing region Z2 which diffuses the light from the light emitting device 14 toward the self lane side in the oblique direction forming the upward angle θ with respect to the horizontal direction. Therefore, on the imaginary vertical screen, the first light distribution pattern PA1 extended in the horizontal direction is formed by the light irradiated from the horizontally diffusing region Z1, and the second light distribution pattern PA2 extended in the oblique direction, which forms the upward angle θ with respect to the horizontal direction, is formed on the self lane side by the light irradiated from the obliquely diffusing region Z2.

Further, as the combined light distribution pattern of the light distribution patterns PA1, PA2, the light distribution pattern PA having the horizontal and oblique cutoff lines CL1, CL2 at the upper end portion is formed.

The first light distribution pattern PA1 is formed as the light distribution pattern elongating the inverted projection image Io of the light emitting chip 14*a* in the horizontal direction, the lower side edge 14*a* of the light emitting chip 14*a* is extended in the horizontal direction from the rear focal point F of the convex lens 12, and therefore, the bright and dark ratio of the upper end edge of the first light distribution pattern PA1 becomes extremely high. Thus, the horizontal cutoff line CL1 can be made clearly.

Further, according to the first exemplary embodiment, the horizontal and the oblique cutoff lines CL1, CL2 can be formed without needing to shield a portion of direct light from the light emitting device 14 by a shade as in a background art. Thus, the luminous flux from the light source can effectively be utilized.

In this way, according to the first exemplary embodiment in the direct-optical type vehicle lamp 10 having the light emitting device 14 as a light source, an utilization efficiency of the luminous flux from the light source can be improved even when the light distribution pattern PA having the horizontal and the oblique cutoff lines CL1, CL2 at the upper end portion is formed. Further, this can be realized by a small-sized and simple lamp configuration.

Particularly, according to the first exemplary embodiment, the region disposed on the opposing lane side of the vertical plane including the optical axis Ax of the front surface 12*a* of the convex lens 12 is configured as the horizontally diffusing region Z1 and the region disposed on the self lane side is configured as the obliquely diffusing region Z2, and, therefore, one or more of the following effects and advantages can be achieved.

That is, the horizontally diffusing region Z1 is preferably configured such that an amount of emitting light directed to the opposing lane side becomes larger than that of emitting light directed to the self lane side from a view point of forming the horizontal cutoff line CL1 having a length to some degree. If the region disposed on the self lane side of the vertical plane including the optical axis Ax is configured as the horizontally diffusing region Z1, an angle of refraction of emitting light at the front surface 12*a* of the convex lens 12 becomes large, and, therefore, a rate of light reflected to an inner face at the front surface 12*a* becomes large, and there is a loss of the luminous flux from the light source by that amount. When the region disposed on the opposing lane side of the vertical plane including the optical axis Ax is configured as the horizontally diffusing region Z1, the angle of refraction of emitting light at the front surface 12*a* of the convex lens 10 becomes small, and, therefore, the rate of light reflected to an inner face of the front surface 12*a* becomes small. Thus, the utilization efficiency of the luminous flux from the light source can be improved.

Similarly, it is preferable that the obliquely diffusing region Z2 is configured such that an amount of emitting light directed to the self lane side becomes larger than that of emitting light directed to the opposing lane side from a view point of forming the oblique cutoff line CL2 having a length to some degree. If the region disposed on the opposing lane side of the vertical plane including the optical axis Ax is configured as the obliquely diffusing region, an angle of refraction of emitting light at the front surface 12*a* of the convex lens 12 becomes large, and, therefore, a rate of light reflected to an inner face at the front surface 12*a* becomes large, and there is a loss of the luminous flux from the light source that amount. When the region disposed on the self lane side of the vertical plane including the optical axis Ax is configured as the obliquely diffusing region Z2, the angle of refraction of emitting light at the front surface 12*a* of the convex lens 12 becomes small, and, therefore, a rate of light reflected to the inner face at the front surface 12*a* becomes small. Thus, the utilization efficiency the luminous flux from the light source can be improved.

Further, according to the first exemplary embodiment the portion of the obliquely diffusing region Z2 is configured as the downward diffusing regions Z2*a*, Z2*b* which downwardly diffuses the light from the light emitting device. Therefore, a brightness of a portion of the low beam light distribution pattern PL1 slightly on self lane side of the elbow point E and below the oblique cutoff line CL2 can be increased, whereby the hot zone HZ can easily be formed to have a desired size and shape.

Second Exemplary Embodiment

Figure 7:
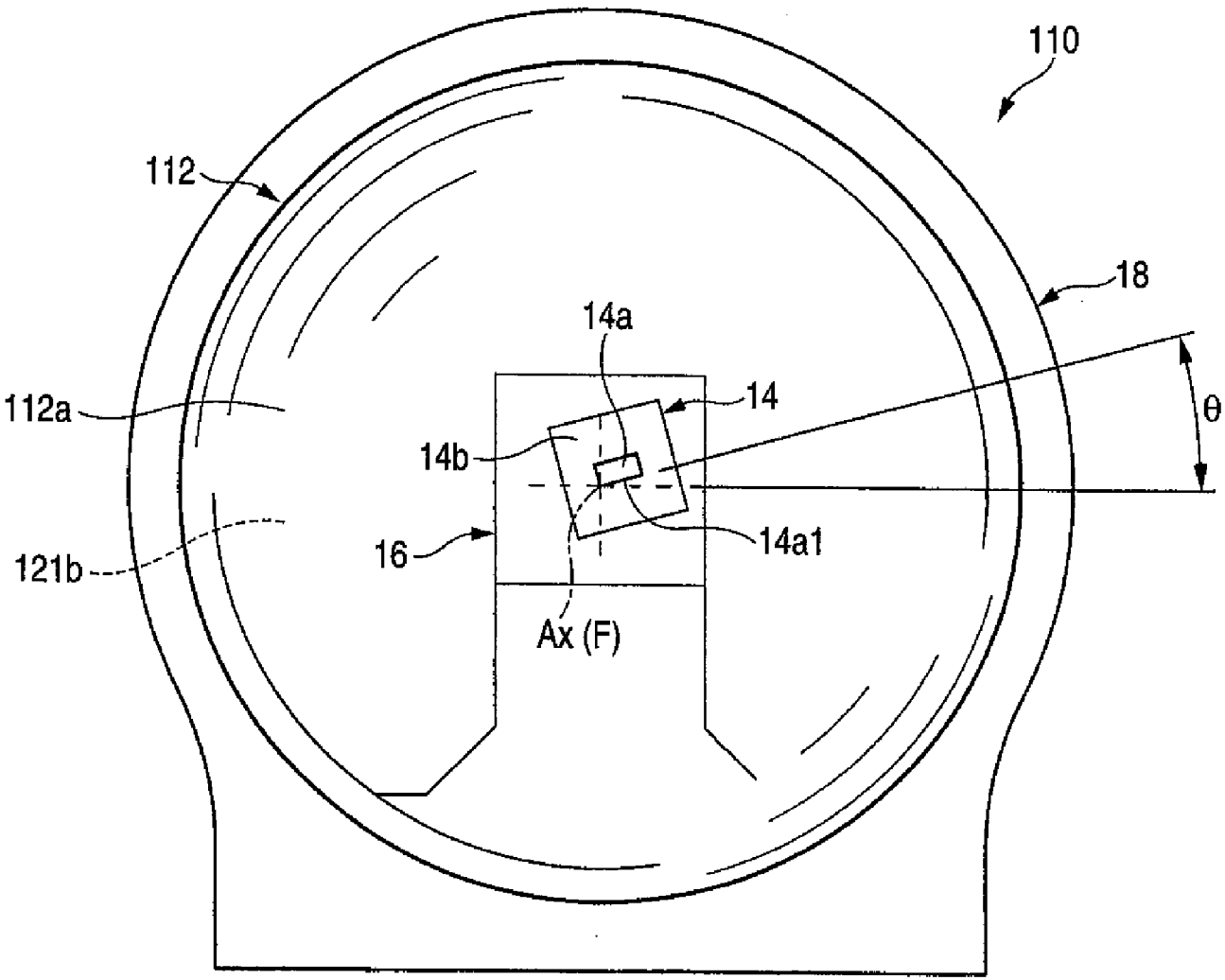
FIG. 7 is a front view showing a vehicle lamp according to a second exemplary embodiment of the invention.

FIG. 7 is a front view of a vehicle lamp 110 according to a second exemplary embodiment.

As shown in FIG. 7, a basic configuration of the vehicle lamp 110 is similar to that of the vehicle lamp 10 of the first exemplary embodiment. However, according to the second exemplary embodiment, an arrangement of the light emitting device 14 and a shape of a convex lens 112 are different from those of the first exemplary embodiment That is, a configuration of the light emitting device 14 per se is similar to that of the first exemplary embodiment However, the light emitting device 14 of the exemplary embodiment is arranged directed to a front side such that the lower side edge 14*a*1 of the light emitting chip 14*a* is disposed on an inclined plane forming an upward angle θ of about 15° with respect to the horizontal plane including the optical axis Ax toward the self lane side, and an end point on the opposing lane side of the lower side edge 14*a*1 is disposed on the rear focal point F of the convex lens 12.

Similar to the vehicle lamp 10 of the first exemplary embodiment, the vehicle lamp 110 is used as a lamp unit of a vehicle headlamp integrated into a lamp body or the like, not illustrated, to be able to adjust an optical axis. Further, at a stage of finishing to adjust the optical axis, the vehicle lamp 110 is arranged such that the optical axis Ax extends in a direction directed to a lower side by about 0.5° to about 0.6° with respect to a front-and-rear direction of a vehicle.

Similar to the convex lens 12 of the first exemplary embodiment, a convex lens 112 of the second exemplary embodiment is has a shape similar to a planoconvex aspherical lens, and is arranged on the optical axis Ax. The convex lens 112 includes a convex front surface 112*a* and a flat rear surface 112*b*. A sectional shape of the front surface 112*a* of the convex lens 112 taken along a vertical plane including the optical axis Ax is a sectional shape of the front surface 112*a* of the planoconvex aspherical lens, and other sectional shapes of the front surface 112*a* of the convex lens 112 taken along a plane other than the vertical plane is more or less deformed sectional shape of the front surface 112*a* of the planoconvex aspherical lens. Therefore, specifically, the rear focal point F of the convex lens 112 is a rear focal point in the vertical plane including the optical axis Ax. Details of the front surface 112*a* of the convex lens 112 will be described later.

Figure 8:
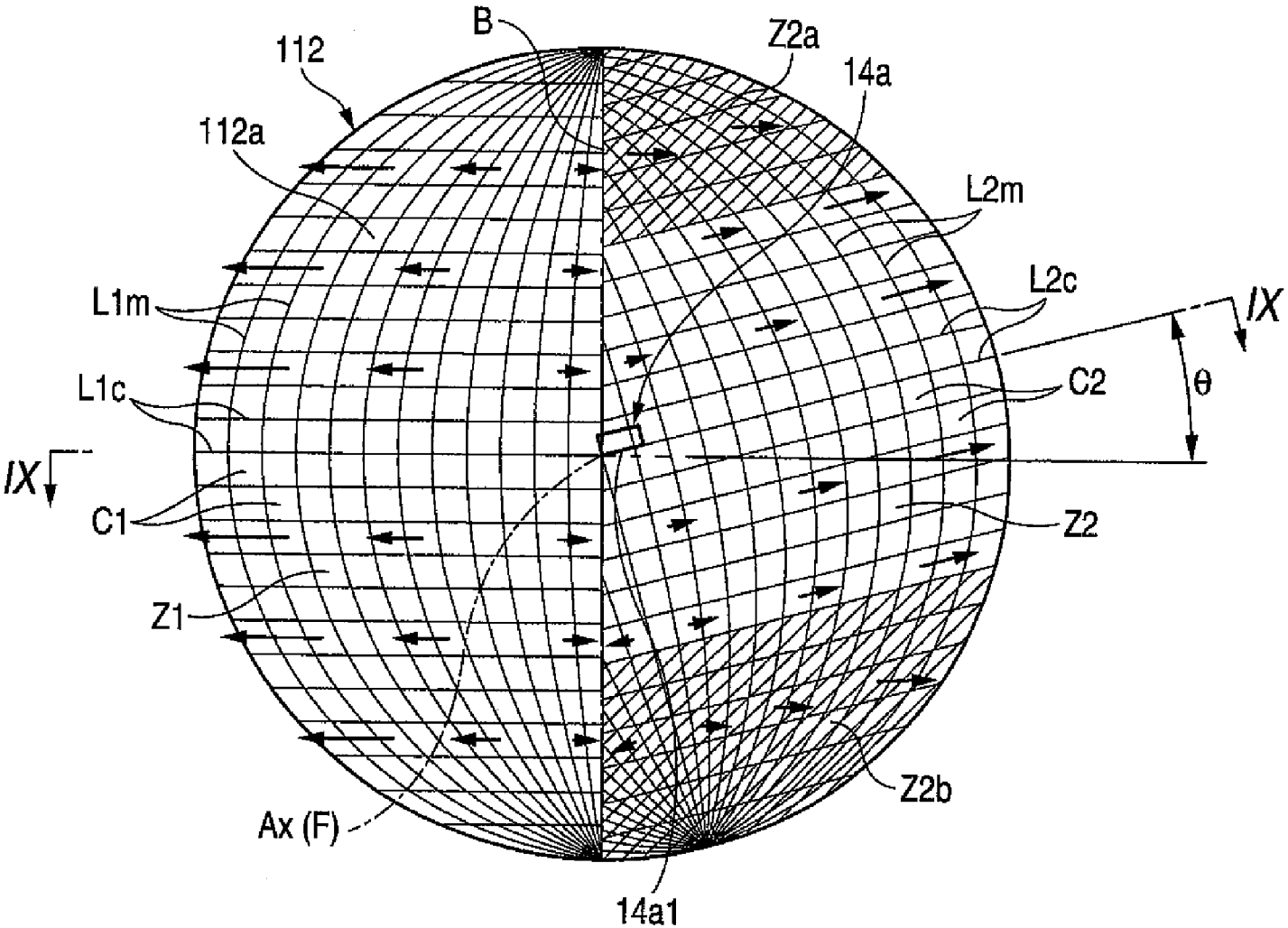
FIG. 8 is a front view showing a convex lens of the vehicle lamp according to the second exemplary embodiment along with a light emitting chip.
Figure 9:
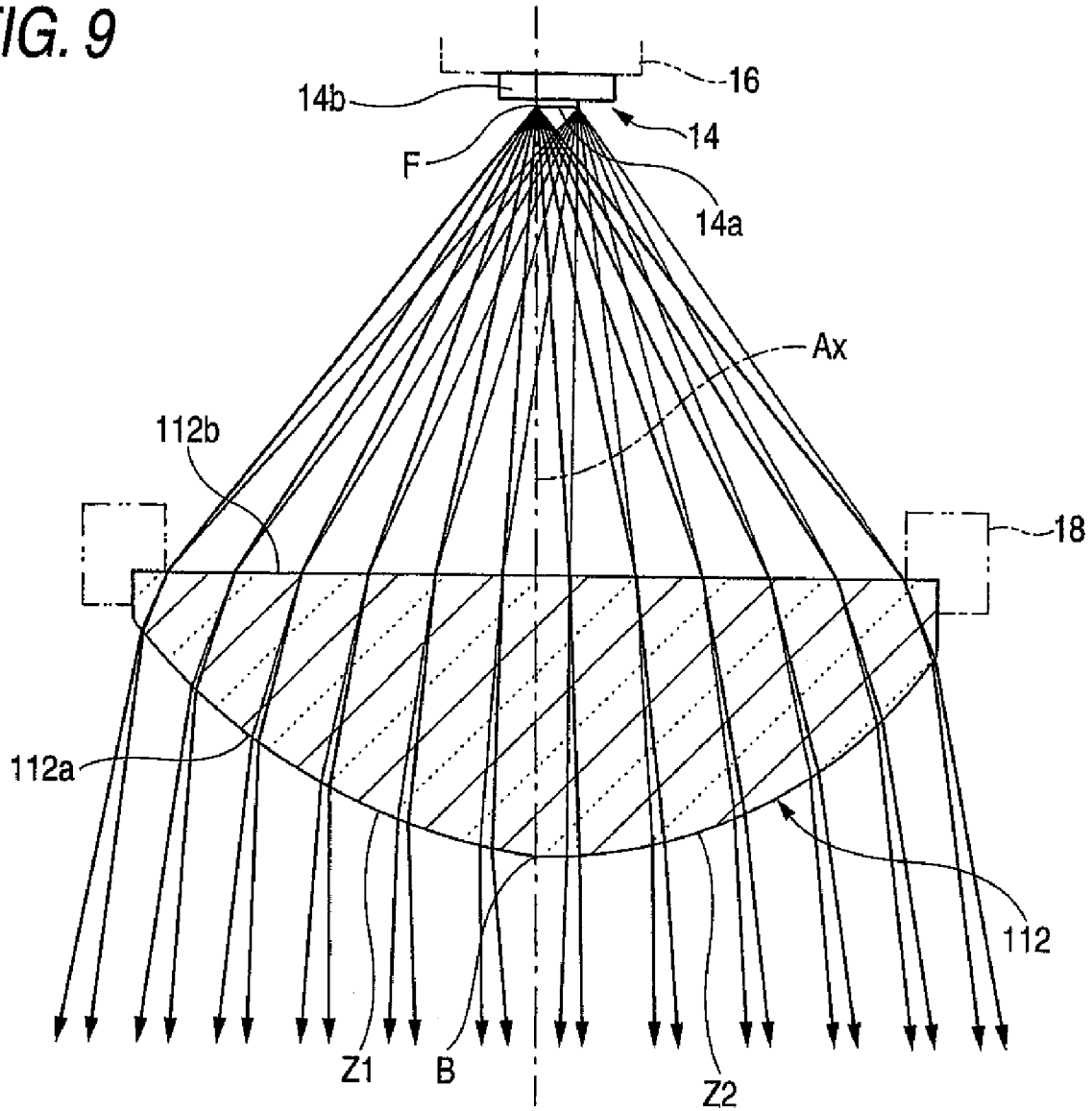
FIG. 9 is a sectional view taken along the line IX-IX in FIG. 8.

FIG. 8 is a front view showing the convex lens 112 along with the light emitting chip 14*a*, and FIG. 9 is a sectional view taken along the line IX-IX in FIG. 8.

As shown in FIGS. 8 and 9, similar to the convex lens 12 of the first exemplary embodiment, the front surface 112*a* of the convex lens 112 includes a horizontally diffusing region Z1 over an entire region on the opposing lane side of the vertical plane including the optical axis Ax, and the obliquely diffusing region Z2 over an entire region on the self lane side of the vertical plane.

Similar to the case of the convex lens 12 of the first exemplary embodiment, the horizontally diffusing region Z1 is partitioned into the plurality of cells C1 and the light emitting directions are set for the respective cells C1.

Specifically, as shown by arrow marks in FIG. 8, at the cells C1 proximate to the boundary line B, directions of the emitting light are directed in left directions by slightly large angles; at the cells C1 proximate to the outer peripheral edge of the convex lens 112, directions of emitting light are set to be in right directions by comparatively large angles; and, at the cells C1 disposed at middle positions thereof, the directions of emitting light are directed in middle directions. At respective stages, directions of emitting light are gradually changed in the horizontal face from the cells C1 contiguous to the boundary line B to the cells C1 contiguous to the peripheral edge of the convex lens 112.

On the other hand, similar to the case of the convex lens 12 of the first exemplary embodiment, the obliquely diffusing region Z2 is partitioned to the plurality of cells, and light emitting directions are set for the respective cells C2.

Specifically, as shown by arrow marks in FIG. 8, at the cells C2 proximate to the boundary line B, directions of emitting light are set to be in left directions by small angles along the curve lines L2*c*; at the cells C2 proximate to the outer peripheral edge of the convex lens 112, directions of emitting light are directed in left directions by angles which are large to some degree; and, at the cells C2 disposed at the middle positions thereof, directions of emitting light are set to be middle directions. According to the second exemplary embodiment even at the cells C2 in fan shape regions surrounded by the curve lines L2*m* extended in obliquely downward directions from the optical axis Ax and the boundary line B, directions of emitting light are set to be slightly in left directions along the curve lines L2*c*. At respective stages, directions of emitting light are gradually changed in inclined plane inclined by the angle θ relative to the horizontal face from the cells C2 contiguous to the boundary line B to the cells C2 contiguous to the outer peripheral edge of the convex lens 112.

The obliquely diffusing region Z2 is configured such that at the upper region Z2*a* and the lower region Z2*b* (regions indicated by hatchings in FIG. 8), light from the light emitting device 14 arriving at the region Z2 is emitted as light diffused to a lower side (accurately, lower side relative to the inclined plane). An amount of deflecting emitting light to the lower side is set such that the more proximate the cells C2 respectively to the upper end point of the boundary line B and the lower end points of the curve lines L2*m* extended from the optical axis Ax to the obliquely downward side, the larger the amount.

Further, arrow marks extended from center positions of the respective cells C1, C2 in FIG. 8 indicate directions of emitting light incident on the convex lens 112 from the end point on the opposing lane side of the lower side edge 14*a*1 of the light emitting chip 14*a* (that is, the position of the rear focal point F of the convex lens 112) from the respective cells C1, C2 as shown by bold arrow marks in FIG. 9.

By forming the front surface 112*a* of the convex lens 112 in this way, the front surface 112*a* becomes a discontinuous surface shape at the boundary line B of the horizontally diffusing region Z1 and the obliquely diffusing region Z2 and the boundary line B is formed as a ridge line.

Figure 10:
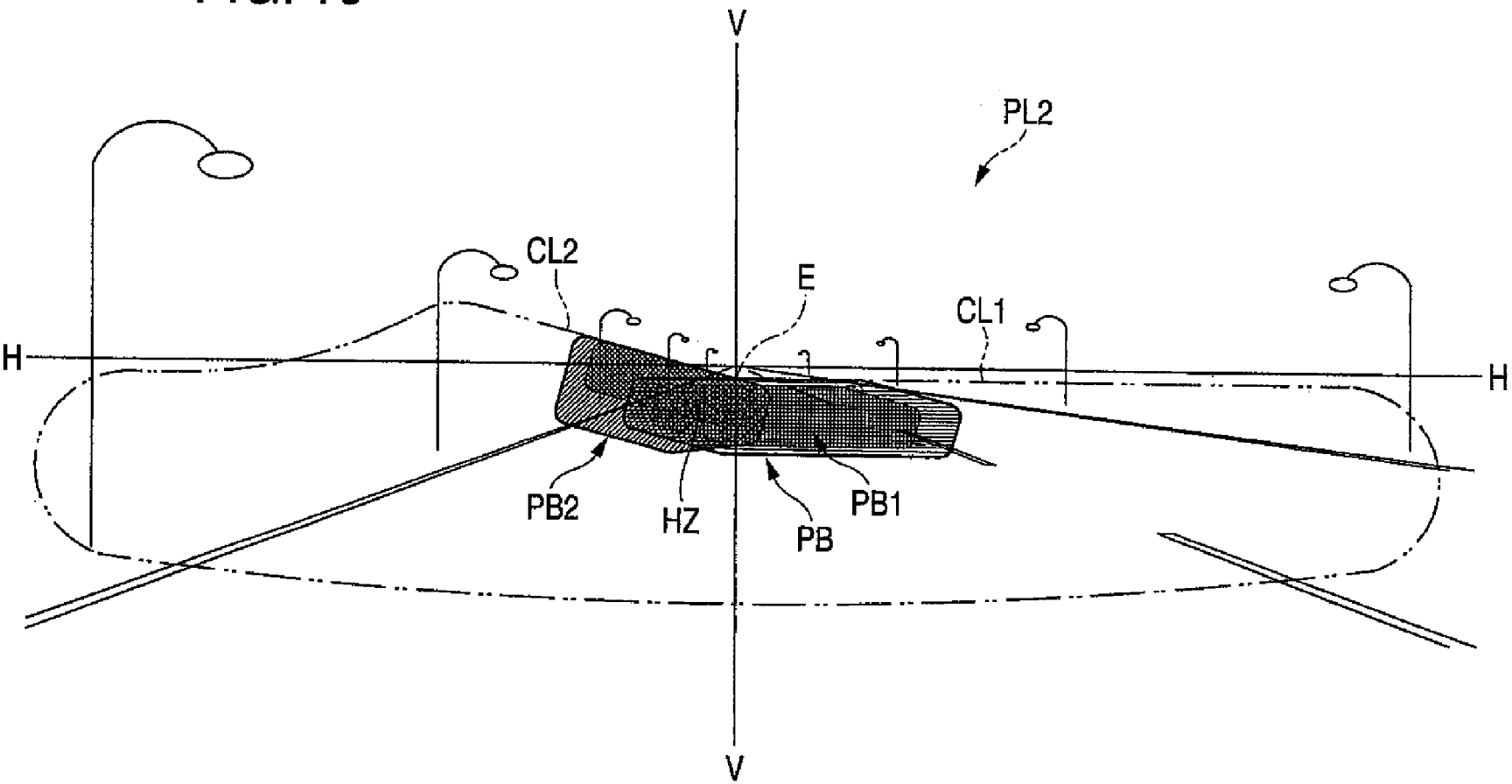
FIG. 10 is a diagram showing a perspective view of a light distribution pattern formed on the imaginary vertical screen by light irradiated to a front side from the vehicle lamp according to the second exemplary embodiment.

FIG. 10 is a diagram showing a perspective view of a light distribution pattern PB formed on an imaginary vertical screen arranged at a position 25 m forward from the lamp by light irradiated to the front side by the vehicle lamp 110 according to the exemplary embodiment As shown in FIG. 10, the light distribution pattern PB is formed at a portion of a low beam light distribution pattern PL2 indicated by two-dotted chain line, and is formed as a combined light distribution pattern of a first light distribution pattern PB1 and a second light distribution pattern PB2. Further, the low beam light distribution pattern PL2 is formed as a combined light distribution pattern of the light distribution pattern PB and a light distribution pattern formed by light irradiated to the front side from other lamp unit, not illustrated.

The low beam light distribution pattern PL2 is for left hand traffic and includes the horizontal and oblique cutoff lines CL1, CL2 at an upper end portion thereof The horizontal cutoff line CL1 is formed on the opposing lane side and the oblique cutoff line CL2 is formed on the self lane side relative to the vertical line V-V passing a vanishing point H-V in the front direction of the lamp, and the elbow point E, which is an intersecting point of the cutoff lines CL1, CL2, is disposed in a lower direction by about 0.5° to about 0.6° from the vanishing point H-V. Further, according to the low beam light distribution pattern PL, the hot zone HZ, which is a high luminous intensity region, is formed to surround the elbow point E particularly on a left side of the elbow point E.

The light distribution pattern PB1 is a light distribution pattern formed by emitting light from the horizontally diffusing region Z1 and is formed such that the upper end edge is made to substantially coincide with the horizontal cutoff line CL1. On the other hand, the light distribution pattern PB1 is a light distribution pattern formed by emitting light from the obliquely diffusing region Z2 and is formed such that the upper end edge is made to substantially coincide with the oblique cutoff line CL2. Further, the hot zone HZ of the light distribution pattern PA2 for low beam is mainly formed by a duplicated portion of the two light distribution patterns PB1, PB2.

Figure 11A:
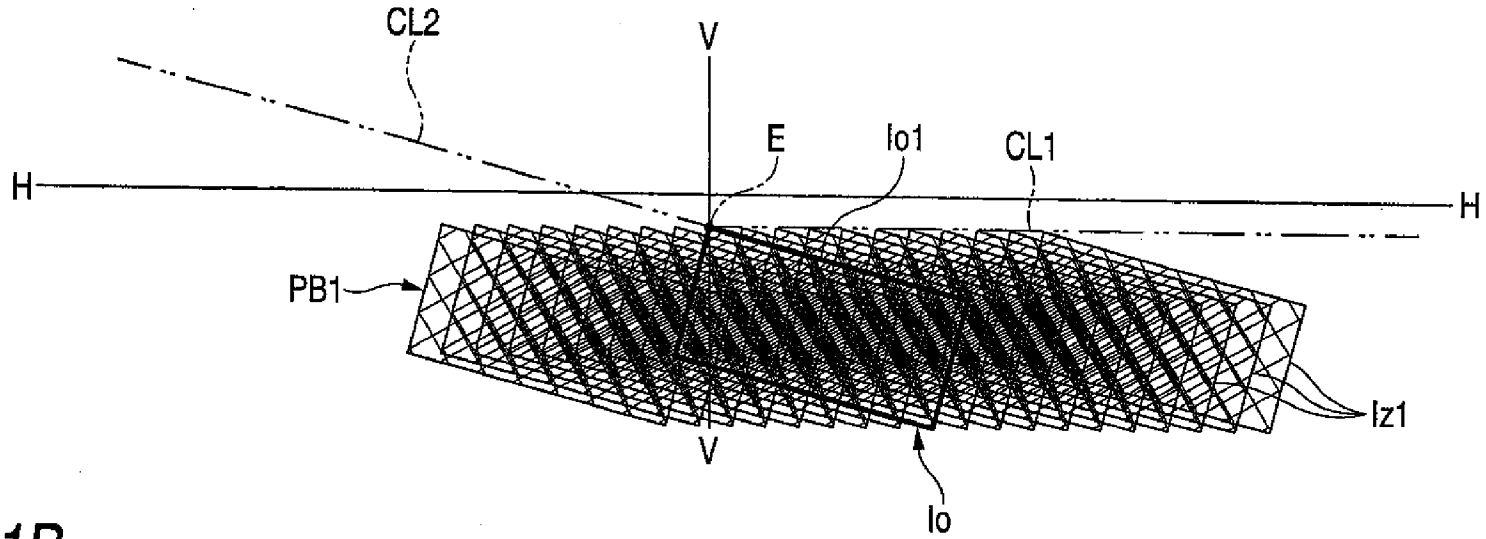
FIG. 11A is a detailed diagram of a first light distribution pattern, which is a portion of the light distribution pattern shown in FIG. 10.
Figure 11B:
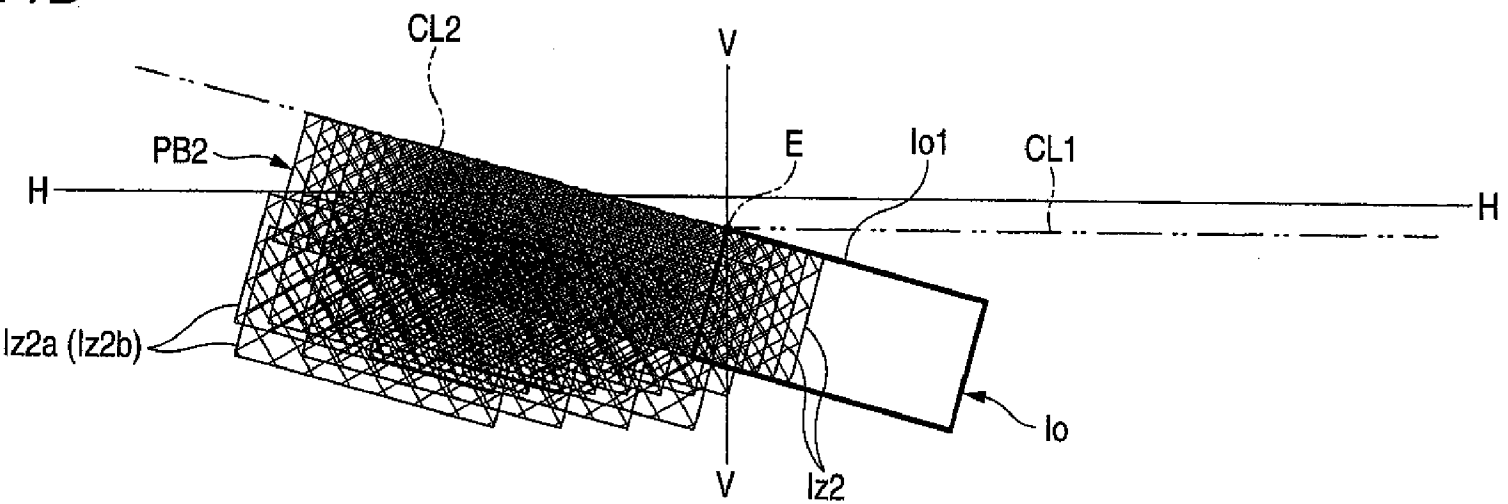
FIG. 11B is a detailed diagram of a second light distribution pattern, which is another portion of the light distribution pattern shown in FIG. 10.

FIG. 11A is a detailed diagram of the light distribution pattern PB1, and FIG. 11B is a detailed diagram of the light distribution pattern PB2.

As shown in FIGS. 11A and 11B, when the convex lens 112 is assumed to be a normal planoconvex aspherical lens, the inverted projection image Io of the light emitting chip 14*a* is formed such that on the imaginary vertical screen, the end point on the self lane side of the upper end edge Io1 is disposed at the position of the elbow point E (i.e., an intersecting of the imaginary vertical screen and the optical axis Ax) and the upper end edge Io1 is disposed on an oblique line passing the elbow point E toward the self lane side in the upward angle θ with respect to the horizontal line. This is because the lower side edge 14*a*1 of the light emitting chip 14*a* is disposed along the inclined plane forming the upward angle θ of about 15° with respect to the horizontal plane including the optical axis Ax toward the self lane side, and the end point of the lower side edge 14*a*1 on the opposing lane side is disposed on the rear focal point F of the convex lens 112.

More specifically, the region of the front surface 112*a* of the convex lens 112 on the opposing lane side of the vertical plane including the optical axis Ax is configured as the horizontally diffusing region Z1 and the region of the front surface 112*a* of the convex lens 112 on the self lane side is configured as the obliquely diffusing region Z2. Therefore, on the imaginary vertical screen, a first light distribution pattern PB1 extended in the horizontal direction is formed by the light irradiated from the horizontally diffusing region Z1, and the light distribution pattern PB2 extended in the oblique direction forming the upward angle θ with respect to the horizontal direction is formed on the self lane side by the light irradiated from the obliquely diffusing region Z2.

In FIG. 11A, a behavior of spreading the first light distribution pattern PB1 is shown by overlapping a plurality of inverted projected images Iz1.

The first light distribution pattern PB1 is formed as a light distribution pattern elongating the inverted projection image Io of the light emitting chip 14*a* to both left and right sides with regard to the horizontal direction. The direction of extending the upper end edge Io1 of the inverted projection image Io and the direction of elongating the inverted projected image Io do not coincide with each other, and, therefore, although a bright and dark ratio of the upper end edge of the first light distribution pattern PB1 is not so high as that of an upper end edge of the second light distribution pattern PB2 described later, clearness to a degree capable of being recognized as the horizontal cutoff line CL1 can sufficiently be ensured.

On the other hand, in FIG. 11B, a behavior of spreading the second light distribution pattern PB2 is shown by overlapping pluralities of inverted projection images Iz2, Iz2*a*, Iz2*b*.

The light distribution pattern PB2 is formed as a light distribution pattern elongating the inverted projection image Io of the light emitting chip 14*a* while being deflected in the left direction with respect to the oblique direction. The upper end edge Io1 of the inverted projection image Io is disposed on the inclined line passing the elbow point E and forming the upward angle θ with respect to the horizontal line toward the self lane side, and, therefore, a bright and dark ratio of the upper end edge of the light distribution pattern PB2 becomes extremely high. Thus, the oblique cutoff line CL2 becomes clear.

In the plurality of inverted projection images Iz2 of the light distribution pattern PB2, the inverted projection images Iz2*a*, Iz2*b* formed by the light irradiated from the upper region Z2*a* and the lower region Z2*b* in the obliquely diffusing region Z2 are disposed slightly below the oblique cutoff line CL2. This is because light emitting from the upper region Z2*a* and the lower region Z2*b* is downwardly diffused.

As explained above in detail, in the vehicle lamp 110 according to the second exemplary embodiment, the light distribution pattern PB having the horizontal and oblique cutoff lines CL1, CL2 at the upper end portion is formed as the combined light distribution pattern of the light distribution patterns PB1, PB2.

The second the light distribution pattern PB2 is formed on the self lane side as an expanded inverted projection image Io of the light emitting chip 14*a* in the oblique direction forming the upward angle θ with respect to the horizontal direction. Because the lower side edge 14*a*1 of the light emitting chip 14*a* is extended from the rear focal point F of the convex lens 112 toward the self lane side in the oblique direction forming the upward angle θ with respect to the horizontal direction, the bright and dark ratio of the upper end edge of the second light distribution pattern PB2 becomes extremely high, thereby, the oblique cutoff line CL2 can be made clearly.

Further, according to the second exemplary embodiment, the horizontal cutoff line CL1 and the oblique cutoff line CL2 can be formed without needing to shield a portion of the direct light from the light emitting device 14 by the shade as in the background art, thereby, the luminous flux from the light source can effectively be utilized.

In this way, according to the second exemplary embodiment, an utilization efficiency the luminous flux from the light source can be improved even when the light distribution pattern PA having the horizontal and oblique cutoff lines CL1, CL2 at the upper end portion is formed in the direct-optical type vehicle lamp 110 having the light emitting device 14 as a light source. Further, this can be realized by a small-sized and simple lamp configuration.

Further, in the second exemplary embodiment, the region disposed on the opposing lane side of the vertical plane including the optical axis Ax in the front surface 112*a* of the convex lens 112 is configured as the horizontally diffusing region Z1 and the region disposed on the self lane side is configured as the obliquely diffusing region Z2, and therefore, the rate of light reflected to the inner face by the front surface 112*a* of the convex lens 112 becomes small, thereby, the utilization efficiency the luminous flux from the light source can be improved.

Further, in the second exemplary embodiment, a portion of the obliquely diffusing region Z2 is configured as the downward diffusing regions Z2*a*, Z2*b* which downwardly diffuses the light from the light emitting device 14. Therefore, a brightness of a portion of the low beam light distribution pattern PL2 slightly on the self lane side of the elbow point E and below the oblique cutoff line CL2 can be increased, whereby the hot zone HZ can easily be formed to have a desired size and shape.

Meanwhile, although the rectangular shape of the light emitting surface of the light emitting chip 14*a* is laterally long in the exemplary embodiments described above, the shape of the light emitting surface of the light emitting chip 14*a* may also be a square or a vertically long rectangle.

Further, although the front surface 12*a*, 112*a* of the convex lens 12, 112 includes the horizontally diffusing region Z1 over the entire region on the opposing lane side of the vertical plane including the optical axis Ax and the obliquely diffusing region Z2 over the entire region on the self lane side of the vertical plane including the optical axis Ax in the exemplary embodiments described above, the horizontally diffusing region Z1 may be a portion of the opposing lane side region of the front surface 12*a*, 112*a* and the obliquely diffusing region Z2 may be a portion of the self lane side region of the front surface 12*a*, 112*a*. For example, a portion or some portions of the front surface 12*a*, 112*a* of the convex lens 12, 112 may be a front surface of a normal planoconvex aspherical lens.

Further, although the rear surface 12*b* of the convex lens 12 is flat in the exemplary embodiments described above, the rear surface 12*b* may have a projected surface or a recessed surface.

Further, although the light distribution pattern PA, PB formed by irradiating light from the vehicle lamps 10, 110 are formed as a portion of the low beam light distribution pattern PL1, PL2 for left hand traffic in the exemplary embodiments described above, the configurations of the vehicular lamp 10, 110 may be reversed in the right-and-left direction to form a portion of a low beam light distribution pattern for right hand traffic without losing the advantages of the exemplary embodiments described above.

Further, the vehicle lamp 10 of the first exemplary embodiment and the vehicle lamp 110 of the second exemplary embodiment may be arranged together in a single vehicle headlamp. According to such a headlamp, the clear horizontal cutoff line CL1 can be provided by the light distribution pattern PA formed by irradiating light from the vehicle lamp 10 and the clear oblique cutoff line CL2 can be provided by the light distribution pattern PB formed by irradiating light from the vehicle lamp 110.

While description has been made in connection with exemplary embodiments of the present invention, those skilled in the art will understand that various changes and modification may be made therein without departing from the present invention. It is aimed, therefore, to cover in the appended claims all such changes and modifications falling within the true spirit and scope of the present invention.

What is claimed is:

1. A vehicle lamp comprising:

a convex lens disposed on an optical axis extending in a front-and-rear direction of a vehicle, the convex lens comprising a front surface and a rear surface; and a light emitting device comprising a light emitting chip, the light emitting chip having a rectangular light emitting surface oriented to face the rear surface of the convex lens, wherein light directly reaching the rear surface of the convex lens from the light emitting device is deflected through the convex lens to form a light distribution pattern having a horizontal cutoff line and an oblique cutoff line along an upper end of the light distribution pattern, wherein a lower side edge of the light emitting chip is disposed along a horizontal plane including the optical axis, and an end point of the lower side edge on a self lane side is disposed on a rear focal point of the convex lens, wherein the front surface of the convex lens comprises:

a horizontally diffusing region which diffuses a part of the light in the horizontal direction; and a first obliquely diffusing region which diffuses another part of the light toward the self lane side in an oblique direction forming an upward angle with respect to the horizontal plane.

2. The vehicle lamp according to claim 1, wherein the horizontally diffusing region is on an opposing lane side of a vertical plane including the optical axis, and the first obliquely diffusing region is on the self lane side of the vertical plane.

3. The vehicle lamp according to claim 1, wherein the front surface of the convex lens further comprises a second obliquely diffusing region which diffuses another part of the light toward the self lane side in a direction forming an angle less than the upward angle with respect to the horizontal plane.

4. The vehicle lamp according to claim 2, wherein the front surface of the convex lens further comprises a second obliquely diffusing region which diffuses another part of the light toward the self lane side in a direction forming an angle less than the upward angle with respect to the horizontal plane, and the second obliquely diffusing region is on the self lane side of the vertical plane.

5. A vehicle lamp comprising:

a convex lens disposed on an optical axis extending in a front-and-rear direction of a vehicle, the convex lens comprising a front surface and a rear surface; and a light emitting device comprising a light emitting chip, the light emitting chip having a rectangular light emitting surface oriented to face the rear surface of the convex lens, wherein light directly reaching the rear surface of the convex lens from the light emitting device is deflected through the convex lens to form a light distribution pattern having a horizontal cutoff line and an oblique cutoff line along an upper end of the light distribution pattern, wherein a lower side edge of the light emitting chip is disposed along an inclined plane forming an upward angle with respect to a horizontal plane including the optical axis, and an end point of the lower side edge on an opposing lane side is disposed on a rear focal point of the convex lens, wherein the front surface of the convex lens comprises:

a horizontally diffusing region which diffuses a part of the light in the horizontal direction; and a first obliquely diffusing region which diffuses another part of the light toward a self lane side in an oblique direction forming the upward angle with respect to the horizontal plane.

6. The vehicle lamp according to claim 5, wherein the horizontally diffusing region is on the opposing lane side of a vertical plane including the optical axis, and the first obliquely diffusing region is on the self lane side of the vertical plane.

7. The vehicle lamp according to claim 5, wherein the front surface of the convex lens further comprises a second obliquely diffusing region which diffuses another part of the light toward the self lane side in a direction forming an angle less than the upward angle with respect to the horizontal plane.

8. The vehicle lamp according to claim 6, wherein the front surface of the convex lens further comprises a second obliquely diffusing region which diffuses another part of the light toward the self lane side in a direction forming an angle less than the upward angle with respect to the horizontal plane, and the second obliquely diffusing region is on the self lane side of the vertical plane.

* * * * *